US005782066A

United States Patent [19]

Giesbrecht

[11] Patent Number: 5,782,066

[45] Date of Patent: Jul. 21, 1998

[54] APPARATUS FOR FILLING A BAG WITH AN ARTICLE LOADED IN A TRAY

[76] Inventor: Kenneth Peter Giesbrecht, 2729 Chestnut Street, Jordan Station, Ontario, Canada, L0R 1S0

[21] Appl. No.: 803,837

[22] Filed: Feb. 21, 1997

[51] Int. Cl.[6] ..... B65B 43/30; B65B 43/18; B65B 43/59

[52] U.S. Cl. ..... 53/573; 53/386.1

[58] Field of Search ..... 53/459, 469, 571, 53/573, 284.7, 386.1; 141/114

[56] References Cited

U.S. PATENT DOCUMENTS

| | | | |
|---|---|---|---|
| 2,964,892 | 12/1960 | Grosjean . | |
| 3,427,780 | 2/1969 | Bock | 53/573 X |
| 3,763,628 | 10/1973 | Bodolay . | |
| 3,792,564 | 2/1974 | Brady, Jr. | 53/573 X |
| 4,345,629 | 8/1982 | Inglett, Jr. | 53/573 X |
| 4,365,458 | 12/1982 | Palmer et al. | 53/449 |
| 4,373,319 | 2/1983 | Pullen et al. | 53/573 |
| 4,534,155 | 8/1985 | Sawa et al. | 53/459 |
| 4,548,243 | 10/1985 | Diaz | 141/114 |
| 4,577,454 | 3/1986 | Wright et al. | 53/573 X |
| 4,664,162 | 5/1987 | Durant | 53/573 X |
| 5,056,299 | 10/1991 | Furukawa | 53/571 |
| 5,056,300 | 10/1991 | Suzuki et al. | 53/572 |
| 5,070,677 | 12/1991 | Hicks | 53/435 |

*Primary Examiner*—Horace M. Culver
*Attorney, Agent, or Firm*—Ridout & Maybee

[57] ABSTRACT

An apparatus for loading an article into a bag. The apparatus comprises a loading station which is positioned adjacent a conveyor carrying the articles to be filled in the bags. The loading station comprises a bag delivery plate, a bag bottom opening plate, a bag opening plate and a pusher arm. The bags are folded flat and stored in a hopper. The bag delivery plate retrieves a bag from the hopper and holds the bag in the loading station. The bag bottom opening plate engages the bottom panel of the bag, while the bag opening plate engages a facing panel of the bag. The bag is opened by actuating the bottom and opening plates. When the bag is open, the pusher arm pushes the article from the conveyor into the opened bag. The filled bag is then moved to another conveyor for packing.

10 Claims, 8 Drawing Sheets

APPARATUS FOR FILLING A BAG WITH AN ARTICLE LOADED IN A TRAY

FIELD OF THE INVENTION

This invention relates to an apparatus for loading a bag, and particularly to an apparatus for opening a bag and loading the bag with a tray filled with goods.

BACKGROUND OF THE INVENTION

In the past, the packaging of goods was performed manually by a number of workers seated along a conveyor carrying the goods. Manual operations of this sort involving a highly repetitive task have given rise to numerous attempts in the art to accelerate the process, and eliminate the need for a worker.

In U.S. Pat. No. 3,763,628, Bodolay discloses a bag loader machine for packing groceries and merchandise at a check-out counter in a store. The items are placed in a tray which is located beside the cashier. When the tray is filled (or all the items have been entered in the cash register), the cover on the tray is closed and a switch is activated to move the filled tray and load the items in the tray into a bag. The bag is opened in a horizontal position and the tray includes a tongue which carries the groceries into the bag. Once the groceries are inside the bag, the tongue is returned to the tray, and the bag is moved to an upright position for delivery to the customer.

In U.S. Pat. No. 5,056,299, Furakawa et al. discloses an apparatus for opening and placing bags on a filling hopper. The apparatus comprises a bag opening device and a guide body for moving the bag from a table to the filling hopper. The bag opening device comprises a pair of vacuum suction cups which engage a bag fed to the table. The guide body moves the bag from the table to the hopper and during the movement from the table to the hopper, the guide body gradually separates the vacuum suction cups to open the mouth of the bag. According to Furakawa, the gradual opening of the bag reduces the number of failures.

In U.S. Pat. No. 5,056,300, Suzuki et al. discloses a bagging apparatus, and bag opening device for bagging articles. The apparatus according to Suzuki is used with a stack of plastic bags. The apparatus includes a separator plate inserting device which inserts a separator plate under the opening of an uppermost bag in the stack. A touching member is then brought from above into contact with the opening of the bag being carried on the separator plate. The touching member grips the upper film of the bag and slides towards the bottom of the bag. The sliding of the upper film lifts the edge of the mouth to open the bag. Once opened an article is pushed into the opening of the bag. Suzuki teaches including a suction device on the surface of the touching member which contacts the bag, and an air nozzle for blasting air toward the opening of the bag to further assist the opening of the bag.

While the prior art is replete with various bag opening apparatus, there is still a need for an apparatus for handling the type of bags commonly used for packaging cookies and biscuits. Such bags have a folded flat bottom and a reusable metal tab for sealing the bag opening. These bags have enjoyed widespread appeal because the bag can be resealed after opening to help preserve the freshness of the remaining cookies or biscuits. Unfortunately, the nature of the bags does not make them suitable for automated bag loading apparatus due to reliability problems. As a result, such bags are loaded manually by workers positioned along a conveyor line carrying trays filled with cookies or biscuits.

BRIEF SUMMARY OF THE INVENTION

The present invention provides an apparatus for opening a flat folded bag of the resealable type and inserting a filled tray into the opened bag.

In a first aspect, the present invention comprises a loading station located adjacent a tray delivery conveyor and another conveyor for receiving filled cookie bags. The loading station comprises a bag delivery plate, a bag opening plate, a bag bottom opening plate and a tray pusher arm. The bag delivery plate comprises a support surface for supporting the bag to be filled and includes a suction or vacuum device for securing one side of the bag. The bag delivery plate is coupled to a movable guide mechanism for retrieving a folded bag stored in a hopper proximate to the loading station. The bag delivery plate holds the folded bag while the bag opening plate and the bag bottom plate engage respective top and bottom panels of the bag and open the bag. The tray pusher arm pushes a tray into the opened bag. The apparatus also includes a gate for directing filled cookie trays from the delivery conveyor to the loading station and another gate for directing a filled cookie bag from the loading station to the bag receiving conveyor.

In operation, the bag delivery plate collects a folded bag from the hopper and moves to the loading station. The gate descends to the tray delivery conveyor to guide the next filled tray to the loading station. The bag delivery plate raises the folded bag to a loading level and the bag opening plate is lowered to contact the top surface of the bag. The bag bottom opening plate is rotated to contact the bottom panel of the folded bag. Each of the bag delivery, bag opening and bag bottom opening plates includes a suction or vacuum device for engaging and securing the respective side and bottom panels of the bag. The bag opening operation begins by rotating the bag bottom opening plate to unfold the bottom panel of the bag. Shortly after the bag bottom opening plate begins rotating, the bag opening plate is raised and the bag is opened against the force of the bag delivery plate holding the lower panel of the bag.

To facilitate the loading of the tray into the opened bag, the apparatus includes top and bottom pusher bar guides. The top pusher guide is rotated into place and partially enters the mouth of the bag. The bottom pusher guide is moved into an engage position where a plate secures the mouth and bottom panel of the bag and provides a ramp for pushing the filled tray from the conveyor into the open bag. Advantageously, the top and bottom guides help hold the opened bag in place. To further facilitate the opening of the bag, the apparatus may also include air nozzles for directing bursts or streams of air into the mouth of the bag in order to expand the bag.

The filled tray is loaded into the open bag by the pusher arm which pushes from the tray from the delivery conveyor through the top and bottom guides and into the open bag. The bag delivery plate is disengaged and the further movement of the pusher arm moves the loaded bag to the bag receiving conveyor. At the completion of the rotation operation to unfold the bottom panel of the bag, the bag bottom opening plate is positioned so that the filled bag can slide from the loading station to the bag delivery conveyor. Once the bag is deposited on the delivery conveyor, the pusher arm moves back to its starting position and the bag delivery plate moves to retrieve a fresh folded bag from the hopper. As the pusher arm clears the loading station, the top and bottom pusher bar guides are returned to their original retracted positions. The cycle is then repeated for the next filled tray arriving in the delivery conveyor.

In a first aspect, the present invention provides an apparatus for loading an article into a bag, the article being delivered on a conveyor adjacent said apparatus and the bag having a folded bottom panel, side panels and upper and lower facing panels, said loading apparatus comprising: (a) a loading station having a bag delivery plate, a bag bottom opening plate, and a bag opening plate; (b) a hopper for supplying bags to said loading station; (c) said loading station including a first actuator coupled to said bag delivery plate for moving said bag delivery plate to said hopper for retrieving a bag from said hopper and returning said bag to the loading station, said bag delivery plate having means for securing one of the facing panels of the bag; (d) said loading station including a second actuator coupled to said bag bottom opening plate for engaging the bottom panel of the bag and moving the bottom panel to an unfolded position; (e) said loading station including a third actuator coupled to said bag opening plate for engaging the other facing panel of the bag and moving the facing panel to open the bag; (f) a pusher arm coupled to a fourth actuator for pushing the article from the conveyor into the opened bag; and (g) a controller coupled to said actuators for controlling the movements of said actuators.

In another aspect, the present invention provides an apparatus for loading an article into a bag, the article being delivered on a conveyor adjacent said apparatus and the bag having a folded bottom panel, side panels and upper and lower facing panels, said loading apparatus comprising: (a) a loading station having a bag delivery plate, a bag bottom opening plate, and a bag opening plate; (b) said loading station including a first actuator coupled to said bag delivery plate for moving said bag delivery plate to engage a bag to be filled and moving said bag to the loading station, said bag delivery plate having means for securing one of the facing panels of the bag; (c) said loading station including a second actuator coupled to said bag bottom opening plate for engaging the bottom panel of the bag and moving the bottom panel to an unfolded position; (d) said loading station including a third actuator coupled to said bag opening plate for engaging the other facing panel of the bag and moving the facing panel to open the bag; (e) a pusher arm coupled to a fourth actuator for pushing the article from the conveyor into the opened bag; and (f) a controller coupled to said actuators for controlling the movements of said actuators.

BRIEF DESCRIPTION OF THE DRAWINGS

Reference will now be made to the accompanying drawings which show, by way of example, a preferred embodiment of the present invention, and in which:

FIG. 4(*b*) shows the bag of FIG. 4(*a*) in an unfolded or open position.

DETAILED DESCRIPTION OF THE PREFERRED EMBODIMENT

Figure 1:
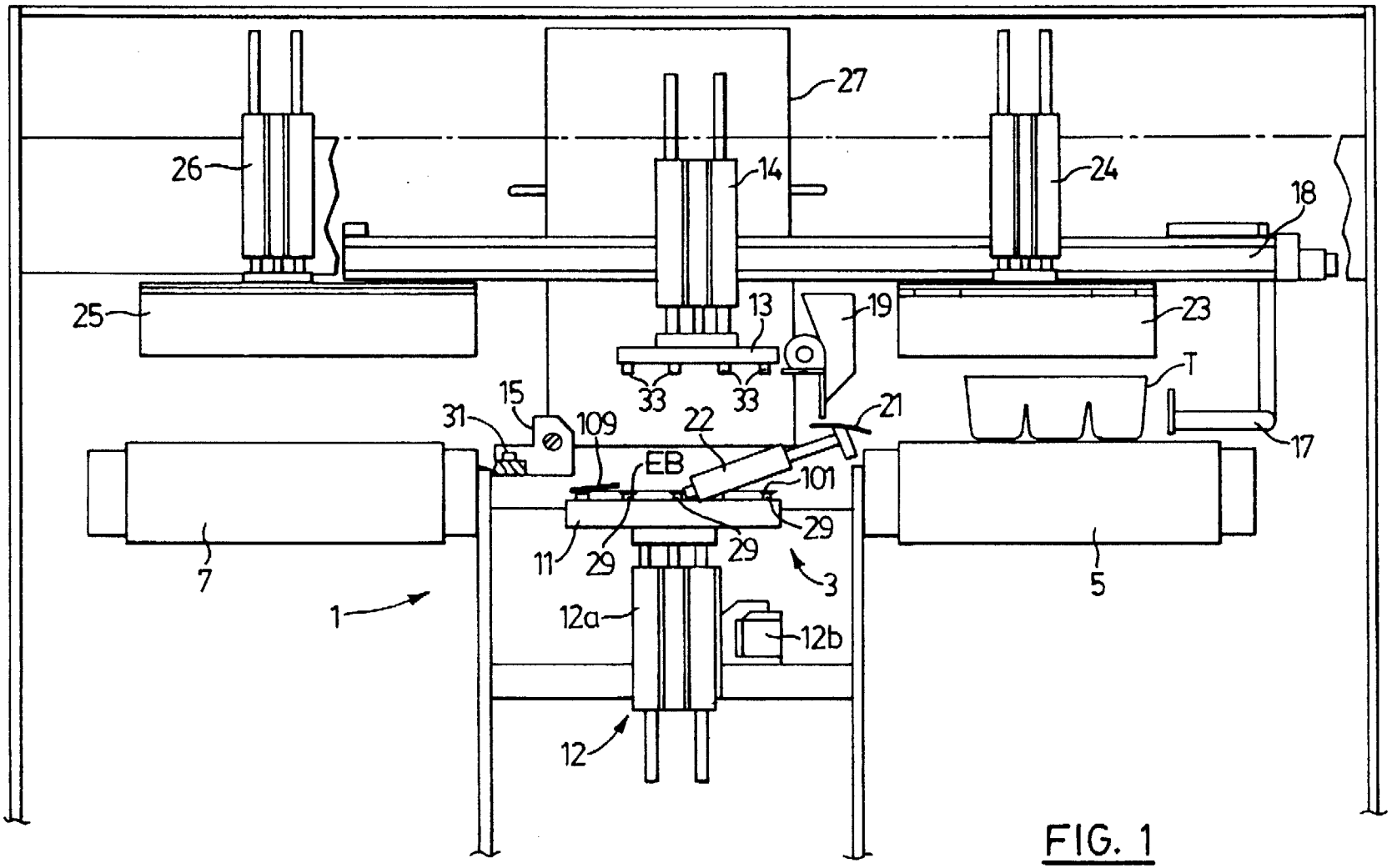
FIG. 1 shows in diagrammatic form a bag loading apparatus according to the present invention.
Figure 2A:
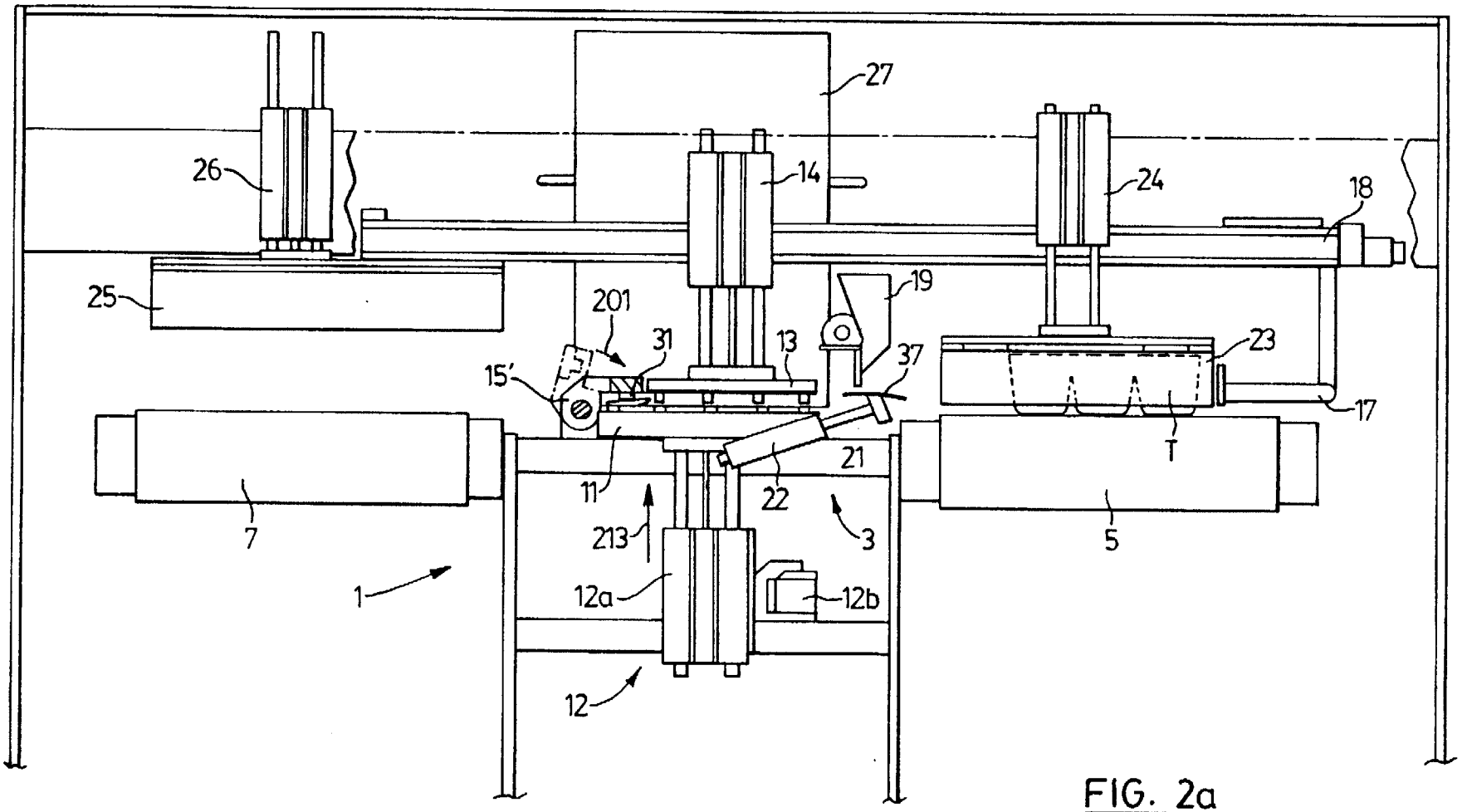
FIGS. 2(*a*) to 2(*e*) show the bag loading apparatus of FIG. 1 in various stages of the bag opening and loading operation according to the present invention.
Figure 2B:
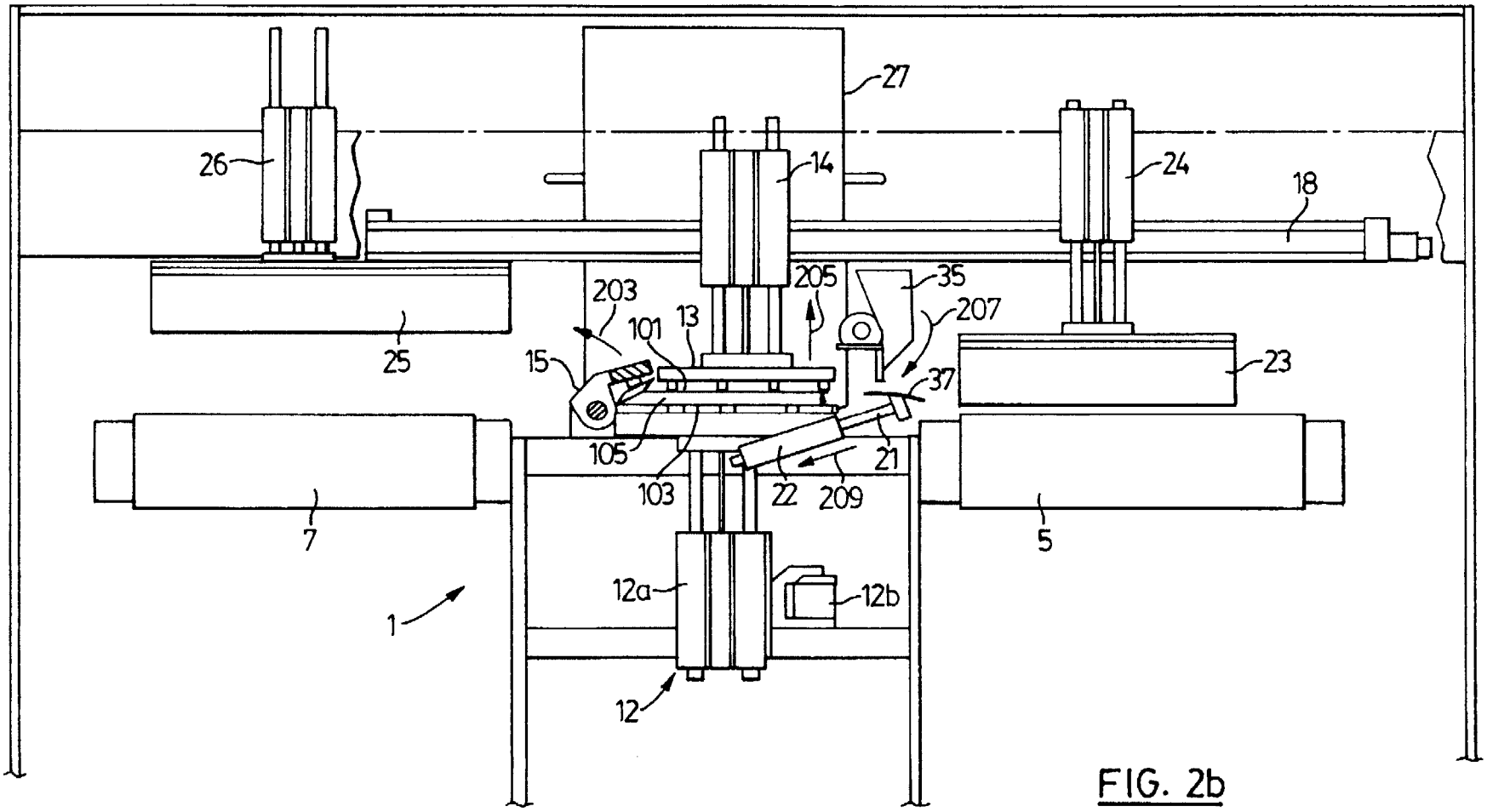
Figure 2C:
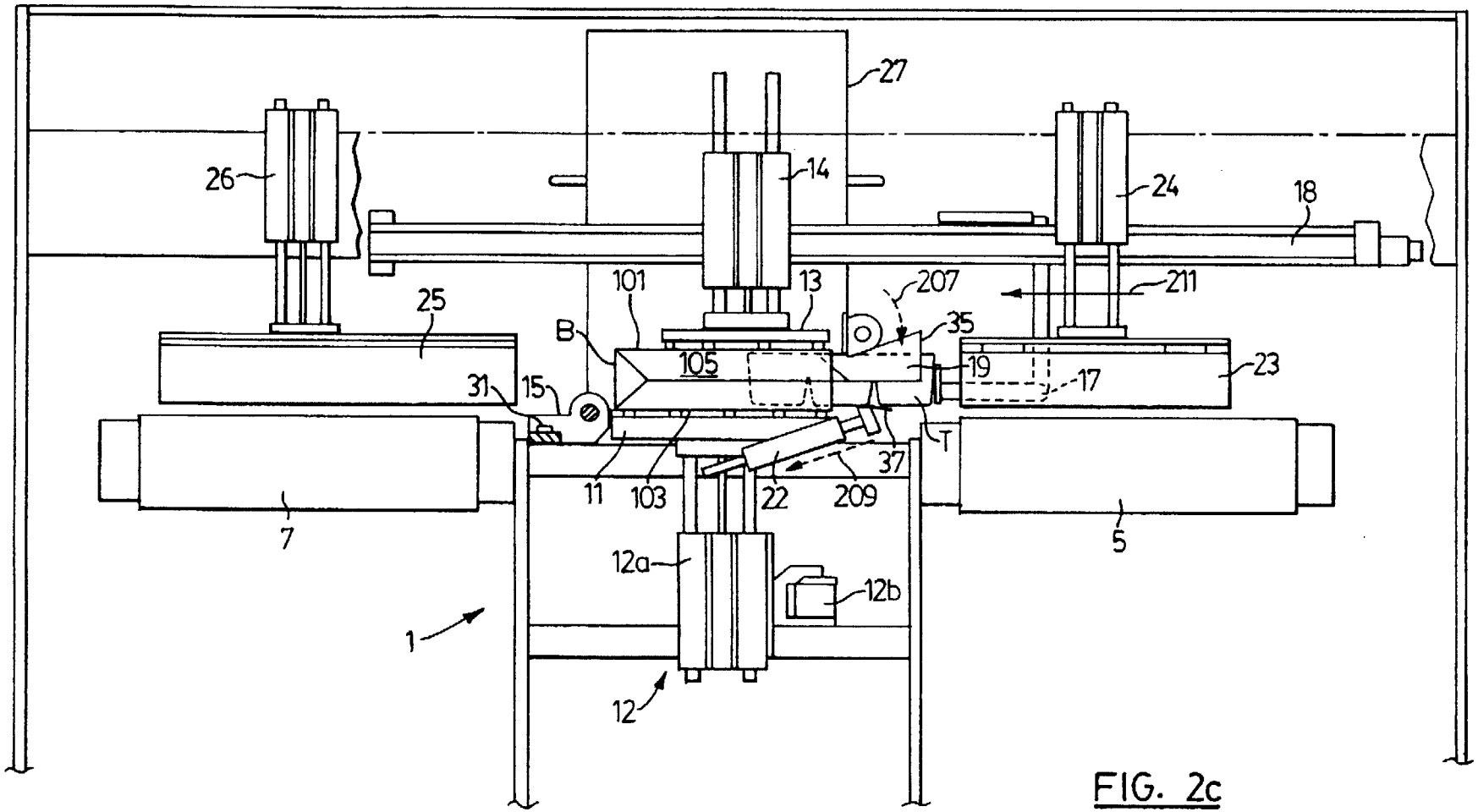
Figure 2D:
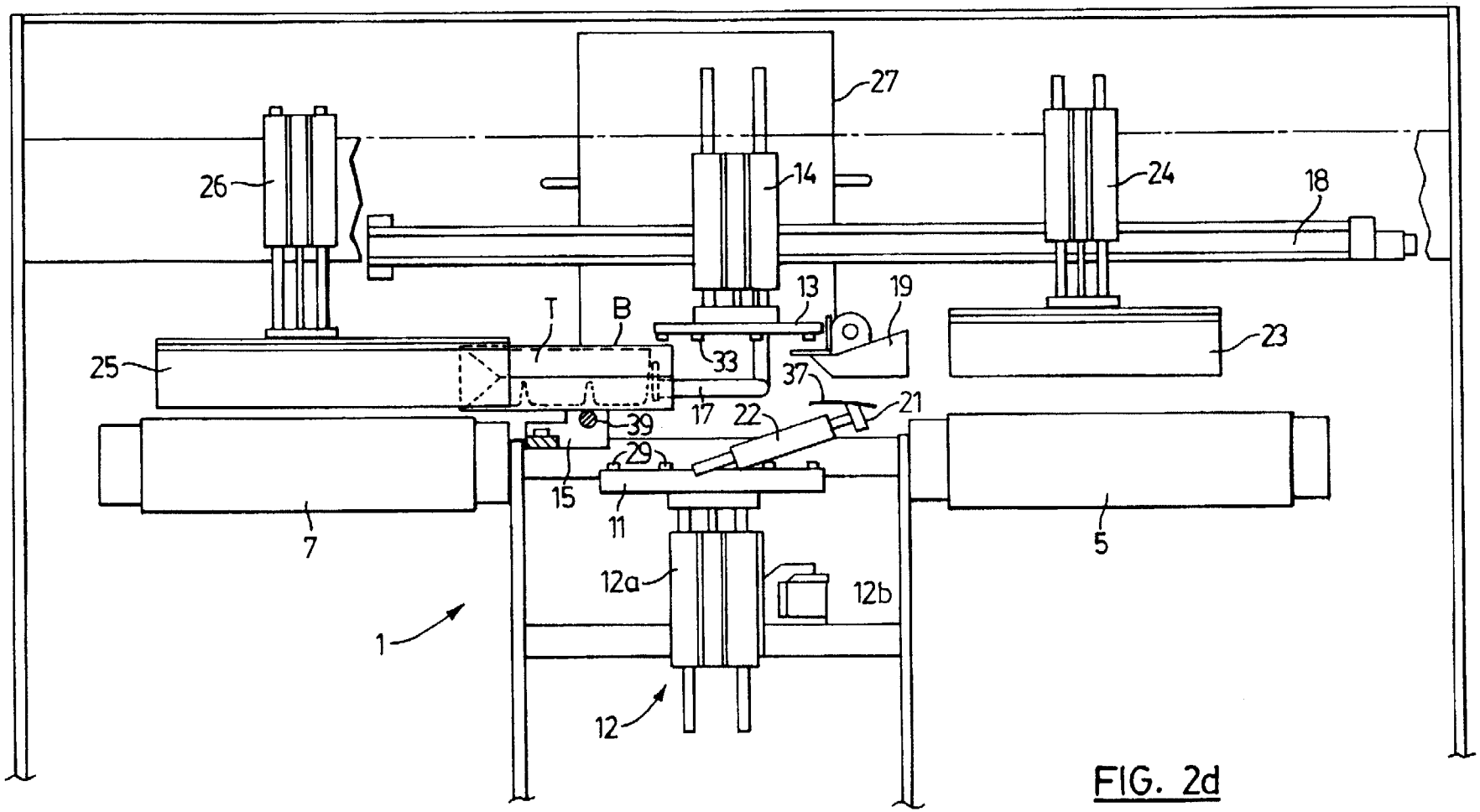
Figure 2E:
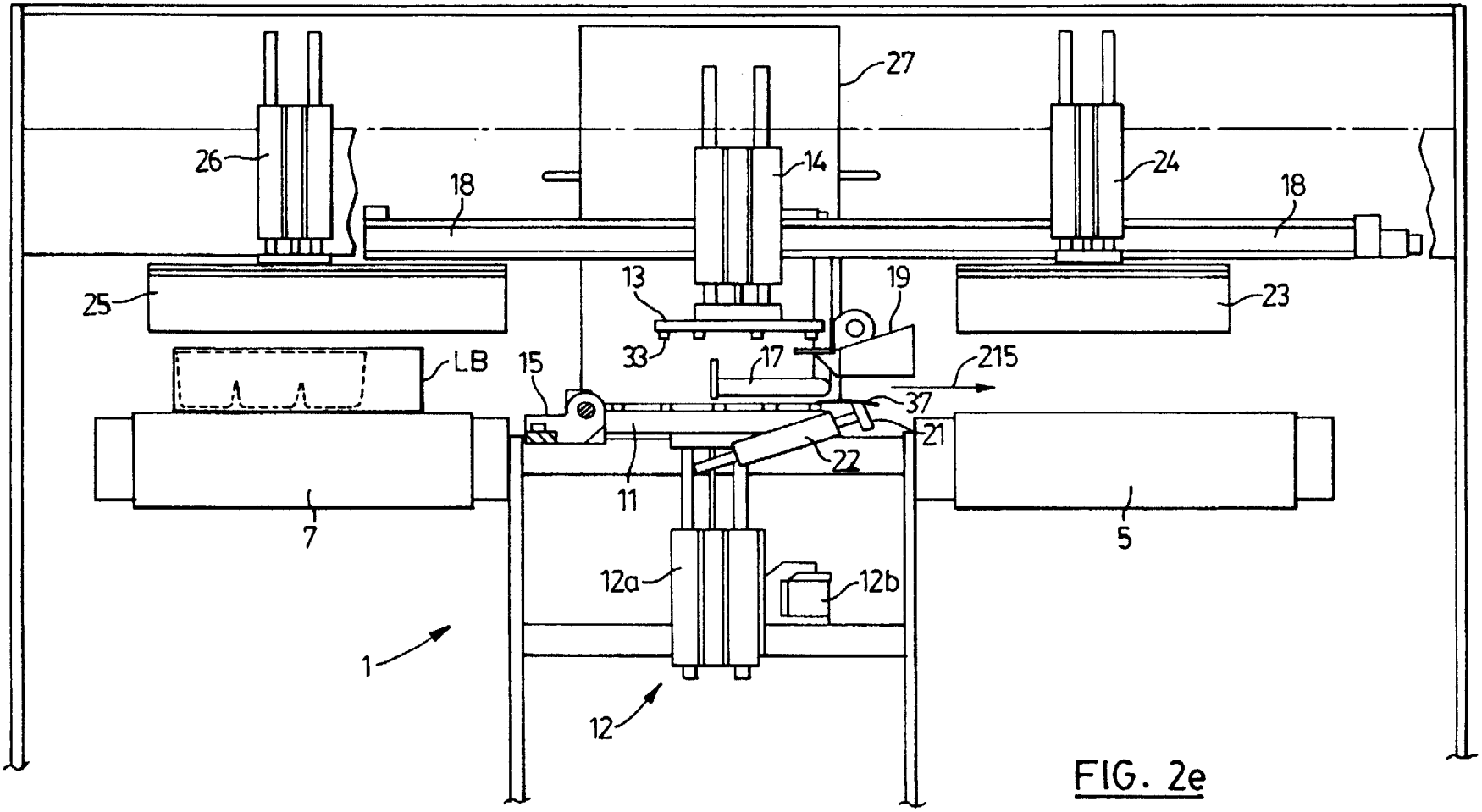
Figure 3:
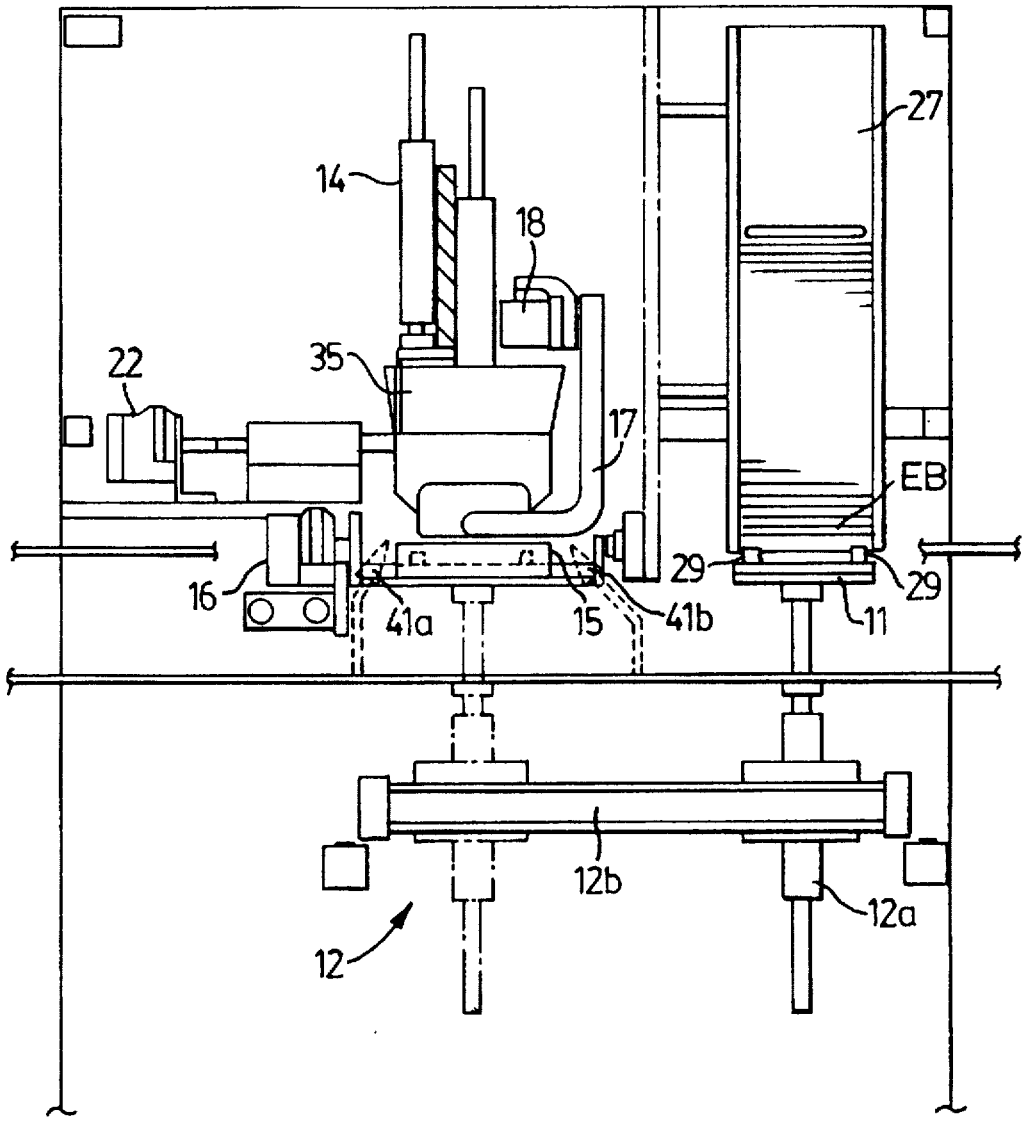
FIG. 3 shows in diagrammatic form an end view of the bag loading apparatus of FIG. 1.

Reference is now made to FIGS. 1 to 3 which show a bag loading apparatus 1 according to the present invention. Like references indicate like elements in the figures. In the following description, the bag loading apparatus 1 is described in the context of an automated packaging line for packaging cookies and biscuits. It will, however, be understood that the apparatus 1 has wider applicability to other packaging applications.

The bag loading apparatus 1 comprises a loading station 3 which is positioned between a tray delivery conveyor 5 and a bag receiving conveyor 7. The tray delivery conveyor 5 comprises a conventional conveyor and in the context of the present invention delivers trays T of cookies or biscuits to the loading station 1. Similarly, the bag receiving conveyor 7 comprises a conventional conveyor and serves the function of receiving and moving a bag LB loaded with a tray T from the loading station 1 (FIGS. 2(*a*) and 2(*e*)) to another station (not shown) for further packing. It will be appreciated that the details of the conveyors 5 and 7 will depend on the configuration of the automated packaging line and will be within the understanding of those skilled in the art, and therefore further explanation is not necessary.

Referring to FIG. 1, the loading station comprises a bag delivery plate 11, a bag opening plate 13 and a bag bottom opening plate 15. The apparatus 1 also comprises a tray pusher bar 17, a top pusher guide 19, a bottom pusher guide 21, a tray conveyor gate 23, and a bag conveyor gate 25. The bag delivery plate 11, bag opening plate 13, tray pusher bar 17, tray conveyor gate 23 and bag conveyor gate 25 are provided with respective actuators 12, 14, 18, 24 and 26 as shown in FIG. 1. The actuators move the respective components through the required operational motion as described below and comprise conventional devices, such as pneumatic cylinders, air-powered cylinders, or the like. The actuator 12 for the bag delivery plate 11 comprises two actuators 12*a* and 12*b*. The first actuator 12*a* provides vertical motion and the second actuator 12*b* provides transverse motion (FIG. 3). Similarly, the bag bottom opening plate 15 and bottom pusher guide 21 have respective actuators 16 (FIG. 3) and 22, which may be implemented using pneumatic cylinders.

Referring to FIGS. 1 and 3, the bag delivery vacuum plate 11 retrieves an empty bag EB from a hopper 27. The hopper 27 is located adjacent or proximate to the loading station 1 and is filled with empty bags EB which are folded flat (FIG. 4(*a*)) and stacked (FIG. 3). The second actuator 12*b* provides the transverse motion to move the bag delivery plate 11 back and forth between the loading station 1 and the hopper 27. The first actuator 12*a* provides the vertical motion for the plate 11, and as shown in FIG. 3, the plate 11 is raised to retrieve the next empty bag EB from the stack loaded in the hopper 27. The bag EB is secured to the bag delivery plate 11 by a suction device 29. The suction device 29 may comprise a series of suction cups or an air-actuated vacuum surface. Once the empty bag EB is engaged, the bag delivery plate 11 returns to the loading station 1.

Figure 4A:
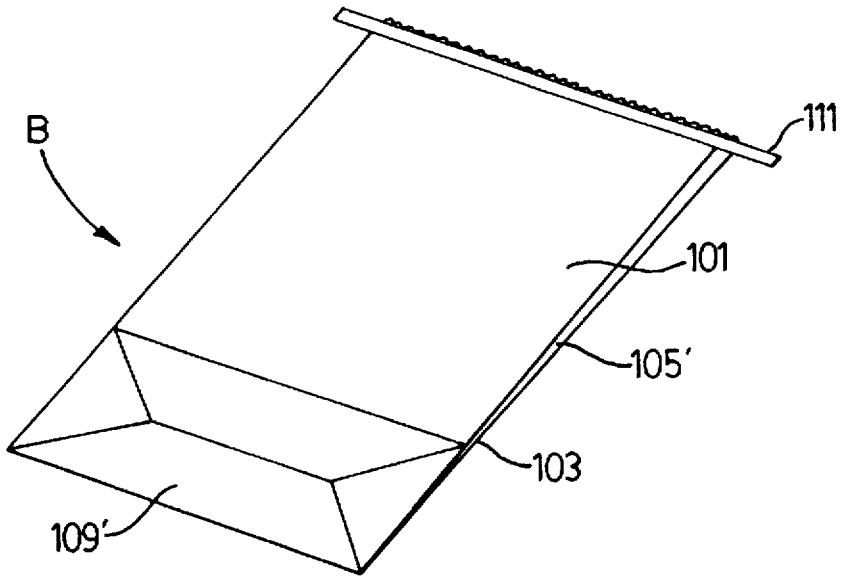
FIG. 4(*a*) shows in diagrammatic form a folded bag of the type for use with the bag loading apparatus of FIG. 1.
Figure 4B:
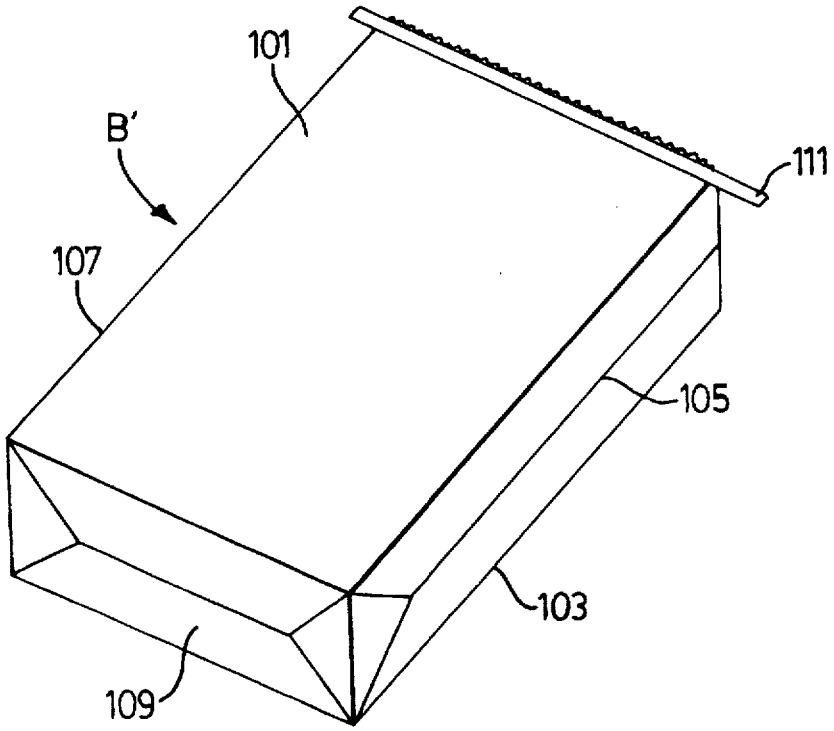

The bag intended for use with apparatus 1 according to the present invention is shown in more detail in FIGS. 4(*a*) and 4(*b*). Referring to FIG. 4(*a*), the bag B arrives folded flat which advantageously allows the bags to be stacked for transport and for loading into the hopper 27. The bag B comprises a front 101 and back 103 panel, side panels 105, 107, and a bottom panel 109 as depicted in FIG. 4(*b*). In the folded position shown in FIG. 4(*a*), the bottom panel 109' is folded over the panel 101 and the side panels (105 being shown) are also folded flat as indicated by 105'. The bag B also includes a reusable metal clasp or tie 111. The bag B is manufactured using known methods and will typically comprise a plastic film/paper laminate or foil/paper/plastic film laminate structure. In the context of the present invention, a principal function of the bag loading apparatus 1 is to open the folded bag B (FIG. 4(*a*)) so that a tray T can be inserted without manual intervention.

As will be described in more detail below, the bag bottom opening plate 15 is actuated to rotate in the direction of arrow 201 (FIG. 2(*a*)) and contact the bottom panel 109 of the folded empty bag EB. The bag bottom opening plate 15 includes a suction device 31 for engaging the bottom panel 109. The suction device 31 may comprise a series of conventional suction cups or a known air-actuated vacuum surface.

The bag opening plate 13 is lowered and raised by the actuator 14. In the lowered position, the plate 13 contacts the top panel 101 of the bag EB, and the plate 13 includes a suction device 33 (e.g. suction cups or an air-actuated vacuum surface). To open the bag EB, the bag bottom opening plate 15 is rotated in direction of arrow 203 (FIG. 2(*b*)), and the bag opening plate 13 is raised in the direction of arrow 205 (FIG. 2(*b*)). When the plate 13 is moved to a raised position in the direction of arrow 205, the bag EB is pulled open by the force exerting on the panel 101 and the resisting force exerted by the bag as delivery plate 11 on the bottom panel 103 of the bag EB and as shown in FIG. 2(*b*) the side panel 105 begins to unfold. The apparatus 1 may also include air nozzles 41*a*, 41*b* (shown in broken outline in FIG. 3). The air nozzles 41*a*, 41*b* are positioned to direct streams or bursts of air into the mouth of the bag EB and thereby assist with opening the bag. The air nozzles 41 comprise conventional devices and are within the knowledge of one skilled in the art.

Referring back to FIG. 1, the top pusher guide bar 19 is rotated into position after the bag EB is opened in the direction of arrow 207 (FIG. 2(*b*)). The top pusher guide bar 19 enters the mouth of the opened bag (FIG. 2(*c*)) and supports the top panel 101 of the bag B and includes a chute 35 which provides a guide for the tray T which will be pushed into the empty bag EB. The bottom pusher bar guide 21 is also moved into position in the direction of arrow 209 (FIG. 2(*c*)). The guide 21 includes a ramp 37 which presses against the lower panel 103 of the bag B and also provides a sliding surface or bridge between the bag delivery plate 11 and the tray delivery conveyor 5. With the top and bottom guides 19, 21 in place, the pusher bar 17 is moved in the direction of arrow 211 (FIG. 2(*c*)) to push the tray T from the delivery conveyor 5 into the opened bag B. While the tray T is being pushed by the pusher bar 17, the bag B is held in place by the suction devices 29 and 33 on the bag delivery 11 and bag opening 13 plates and the bottom pusher guide 21.

The sequencing of the actuators is controlled by a sequencing circuit comprising limit switches or by a more elaborate programmable logic controller or PLC. The implementation of a suitably programmed controller or sequencer is within knowledge of one skilled in the art and further description is not necessary for that reason.

Reference will now be made to FIGS. 2(*a*) to 2(*e*) to describe a complete loading cycle for the bag loading apparatus 1 in accordance with the present invention. Referring first to FIG. 2(*a*), the bag delivery plate 11 has collected an empty bag EB from the hopper 27 and returned to the loading station 1. Next, the gate 23 is lowered onto the tray delivery conveyor 5 to redirect the next tray T (shown in broken outline in FIG. 2(*a*)) into the loading station 1. At the same time, the bag delivery plate 11 is raised in the direction of arrow 213 to a loading level, and the bag bottom opening plate 15 is rotated in the direction of arrow 201 to contact the bottom panel 109 of the bag EB (FIG. 4(*a*)). The suction device 31 on the bottom opening plate 15 engages the bottom panel 109 of the bag EB. Next, the bottom opening plate 15 moves back in the direction of arrow 203 (FIG. 2(*b*)) and begins to unfold the bottom panel 109 from the top panel 101 of the folded empty bag EB.

At about the same time, the air nozzles 41 (if installed) are activated and the bag opening plate 13 is moved in the direction of arrow 205 (FIG. 2(*b*)) and the bag B is opened by the force exerted on the top panel 101 by the bag opening plate 13 and the force exerted on the bottom panel 109 by the bottom opening plate 15. It has been found that a better opening action is achieved when the bag opening plate 13 is actuated slightly after the bottom opening plate 15 is actuated.

Once the bag B is opened as shown in FIG. 2(*c*), the top pusher bar guide 19 is moved in the direction of arrow 207 to engage the mouth of the bag B, and the bottom pusher bar guide 21 is moved in the direction of arrow 209 to engage the lower panel 103 and position the ramp 37 for sliding the tray T from the delivery conveyor 9 into the mouth of the bag B. Advantageously, the bottom pusher bar guide 21 holds the lower panel 103 and helps prevent the bag B from coming loose from the bag delivery plate 11 as the tray T is pushed into the bag B.

With the bag B fully open and the guides 19, 21 in position, the pusher bar 17 is actuated to move in the direction of arrow 211 (FIG. 2(*c*)) and push the tray T from the delivery conveyor 9 into the bag B. When the tray T has been fully inserted into the bag B, the pushing bar 17 continues to push in the direction of arrow 211 to move the tray T together with the bag B from the loading station 1 and onto the bag receiving conveyor 7. The bag bottom opening plate 15 may include a roller 39 which contacts the bottom of the bag B and assists moving the loaded bag B onto the bag receiving conveyor 7 (FIG. 2(*d*)). At approximately the same time the pushing bar 17 begins to push the loaded bag B onto the bag receiving conveyor 7, the bag opening plate 13 is moved up to disengage the top panel 101 of the bag B and the bag delivery plate 11 is lowered to disengage the lower panel 103 of the bag B. If the suction devices 29, 33 for the plates 11, 13 comprise air-actuated vacuum surfaces, then the suction devices are de-activated before moving the plates 11, 13.

The bag delivery plate 11 continues to travel to the hopper 27 and retrieve another folded empty bag EB. The gate 23 is also raised around this time in order to allow other trays T to pass while the loading cycle is completed. (In some applications, it may be advantageous to arrange a series of loading apparatus 1 along a conveyor 9 and have one apparatus load every second tray, and one apparatus load every third tray and so on.) Once the pusher bar 17 has moved the loaded bag B onto the bag receiving conveyor 7 (FIG. 2(*c*)), the pusher bar 17 is moved back in the direction of arrow 215 (FIG. 2(*e*) to its starting position, i.e. over the tray delivery conveyor 9. As the pusher bar 17 travels past the loading station 1, the bag delivery plate 11 is raised to engage the next bag EB from the hopper 27 (FIG. 3), and once the bar 17 has cleared the station 1, the top 19 and bottom 21 guides are returned to their original positions (FIG. 2(*a*)). The loading cycle is now complete, and the next cycle commences with the arrival of the next tray T.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An apparatus for loading an article into a bag, the article being delivered on a conveyor adjacent said apparatus and the bag having a folded bottom panel, side panels and upper and lower facing panels, said loading apparatus comprising:

(a) a loading station having a bag delivery plate, a bag bottom opening plate, and a bag opening plate;

(b) a hopper for supplying bags to said loading station;

(c) said loading station including a first actuator coupled to said bag delivery plate for moving said bag delivery plate to said hopper for retrieving a bag from said hopper and returning said bag to the loading station, said bag delivery plate having means for securing one of the facing panels of the bag;

(d) said loading station including a second actuator coupled to said bag bottom opening plate for engaging the bottom panel of the bag and moving the bottom panel to an unfolded position;

(e) said loading station including a third actuator coupled to said bag opening plate for engaging the other facing panel of the bag and moving the facing panel to open the bag;

(f) a pusher arm coupled to a fourth actuator for pushing the article from the conveyor into the opened bag; and (g) a controller coupled to said actuators for controlling the movements of said actuators.

2. The loading apparatus as claimed in claim 1, wherein said loading station includes a lower guide member and a fifth actuator for moving said lower guide member to secure the facing panel engaged by said bag delivery plate when the bag is opened.

3. The loading apparatus as claimed in claim 2, wherein said lower guide member includes a ramp for providing a sliding surface between said conveyor and said loading station.

4. The loading apparatus as claimed in claim 2, wherein said loading station includes an upper guide member coupled to a sixth actuator, said sixth actuator being operative for moving the upper guide member into the opened bag and said upper guide member guiding movement of said article from the conveyor into the opened bag.

5. The loading apparatus as claimed in claim 1, further including a gate positioned over said conveyor and an actuator coupled to said gate for lowering said gate for directing the article to said loading station.

6. The loading apparatus as claimed in claim 5, further including a second gate, said second gate being positioned over a second conveyor for receiving and transporting said article filled bags, and an actuator coupled to said second gate for directing transport of said article filled bag.

7. The loading apparatus as claimed in claim 1, wherein said bag delivery plate, said bag bottom opening plate and said bag opening plate include suction devices for securing respective panels of the bag.

8. The loading apparatus as claimed in claimed in claim 4, wherein said actuators comprises pneumatic cylinders.

9. An apparatus for loading an article into a bag, the article being delivered on a conveyor adjacent said apparatus and the bag having a folded bottom panel, side panels and upper and lower facing panels, said loading apparatus comprising:

(a) a loading station having a bag delivery plate, a bag bottom opening plate, and a bag opening plate;

(b) said loading station including a first actuator coupled to said bag delivery plate for moving said bag delivery plate to engage a bag to be filled and moving said bag to the loading station, said bag delivery plate having means for securing one of the facing panels of the bag;

(c) said loading station including a second actuator coupled to said bag bottom opening plate for engaging the bottom panel of the bag and moving the bottom panel to an unfolded position;

(d) said loading station including a third actuator coupled to said bag opening plate for engaging the other facing panel of the bag and moving the facing panel to open the bag;

(e) a pusher arm coupled to a fourth actuator for pushing the article from the conveyor into the opened bag; and (f) a controller coupled to said actuators for controlling the movements of said actuators.

10. The apparatus as claimed in claim 9, further including a hopper for storing a supply of bags, said hopper having a port for communicating with said bag delivery plate for retrieving one of said bags.

* * * * *